United States Patent [19]

Geschwender

[11] Patent Number: 4,577,767

[45] Date of Patent: Mar. 25, 1986

[54] KNOCKDOWN RACK

[75] Inventor: Robert C. Geschwender, Lincoln, Nebr.

[73] Assignee: New Products I, Inc., Lincoln, Nebr.

[21] Appl. No.: 493,607

[22] Filed: May 11, 1983

[51] Int. Cl.[4] ..... A47F 5/01

[52] U.S. Cl. ..... 211/190; 108/111; 248/165; 211/193

[58] Field of Search ..... 211/71, 186, 207, 187, 211/193, 133, 189, 194, 33, 190; 248/163, 165, 188; 108/59, 111

[56] References Cited

U.S. PATENT DOCUMENTS

| | | | |
|---|---|---|---|
| 311,408 | 1/1885 | Butcher | 211/186 X |
| 1,437,256 | 11/1922 | Martin . | |
| 1,858,299 | 5/1932 | Korn | 248/163.1 X |
| 1,897,905 | 2/1933 | Johnson | 248/163.1 |
| 2,306,879 | 12/1942 | Hamilton et al. | 248/188 |
| 2,886,186 | 5/1959 | Hamilton | 211/186 X |
| 2,919,149 | 12/1959 | Farley | 287/54 |
| 3,035,362 | 5/1962 | Kweskin | 40/124 |
| 3,677,416 | 7/1972 | Block et al. | 211/186 |
| 4,064,993 | 12/1977 | Getner | 248/165 X |

FOREIGN PATENT DOCUMENTS

| | | | |
|---|---|---|---|
| 385442 | 3/1965 | Switzerland | 248/316.3 |

*Primary Examiner*—Robert W. Gibson, Jr.

*Attorney, Agent, or Firm*—Senniger, Powers, Leavitt and Roedel

[57] ABSTRACT

A knockdown rack comprising three vertical posts having diverging legs at their lower ends for stably supporting the rack and a pair of supports fastened between the posts at vertically spaced locations for rigidly interconnecting the posts in a formation wherein the posts lie generally on a first circle with the posts spaced at about 120 degree intervals on the circle and the lower ends of said legs lie generally on a second circle larger in diameter than the first circle. Each support comprises a relatively flat horizontal member having three peripheral recesses therein for receiving the posts. Each recess has a mouth for insertion of a respective post inwardly through the mouth into the recess and a wall structure formed and configured for contact by the post at three separate locations on the circumference of the post. The wall structure has a height not substantially less than the diameter of a respective post for engagement with a substantial length of the post at spaced lines of contact. Each post is releasably fastened in a respective recess in each support member by a bolt.

23 Claims, 7 Drawing Figures

KNOCKDOWN RACK

BACKGROUND OF THE INVENTION

This invention relates generally to apparatus for hanging or displaying a multitude of items, and more particularly to a knockdown rack.

Many of the customary and conventional means for temporarily storing articles, such as clothing, hats, umbrellas, garden utensils, etc., are permanently secured to the building, such as hooks and hangers directly attached to a wall or door or arranged on a pegboard similarly secured to a wall, etc. Mounting such storage arrangements is time consuming and requires a relatively large area to accommodate a few articles because of the limitations of the flat or two-dimensional space available. Movable racks or stands have also been used but these, to be sufficiently strong and sturdy, are usually made of wood and quite expensive. Further, as they usually have a single vertical post and a few hooks at the top, they also have a very limited capacity and can be used only for clothes, hats and possibly an umbrella, etc. Also, such racks are not knockdown and are inconvenient and awkward to ship. The knockdown racks now in use are less expensive but are also quite limited as to the number and type of articles they can accommodate and have a very restricted capacity as far as the weight, size and type of articles they can safely and conveniently support. Also, they are susceptible to bending and twisting and lack stability if relatively large articles are placed on them.

The knockdown rack of this invention is especially useful for hanging or supporting a wide variety of different articles typically requiring a place for deposit for a limited time. Not only hats, jackets, umbrellas, scarves, but also tennis rackets, fishing poles, garden utensils and even skis and water hose are all conveniently accommodated by this rack thus making it particularly useful not only in the living quarters of the home but in utility areas.

Reference may be made to U.S. Pat. Nos. 1,437,256 and 3,035,362 which disclose stands broadly similar to the rack of this invention.

SUMMARY OF THE INVENTION

Among the several objects of this invention may be noted the provision of an improved knockdown rack which, when heavy items are placed thereon, will not rack or rotate; the provision of a rack which has maximum structural strength with minimal material thereby making it relatively lightweight; the provision of a rack which has a wide variety of uses and the configuration of which can be easily changed; the provision of a rack which can accommodate a relatively large number of articles of varying weight, size and type; the provision of a rack which is easy and convenient to package for shipment; and the provision of a rack which is simple, sturdy and economical in construction.

Generally, a knockdown rack of this invention comprises three vertical posts having diverging legs at their lower ends for stably supporting the rack and a pair of supports fastened between the posts at vertically spaced locations for rigidly interconnecting the posts in a formation wherein the posts lie generally on a first circle with the posts spaced at about 120 degree intervals on the circle and the lower ends of said legs lie generally on a second circle larger in diameter than the first circle. Each support comprises a relatively flat horizontal member having three peripheral recesses therein for receiving the posts. Each recess has a mouth for insertion of a respective post inwardly through the mouth into the recess and a wall structure formed and configured for contact by the post at three separate locations on the circumference of the post. The wall structure has a height not substantially less than the diameter of a respective post for engagement with a substantial length of the post at the locations of contact. Bolts releasably fasten each post in a respective recess in each support member.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figures 1, 2, 3:
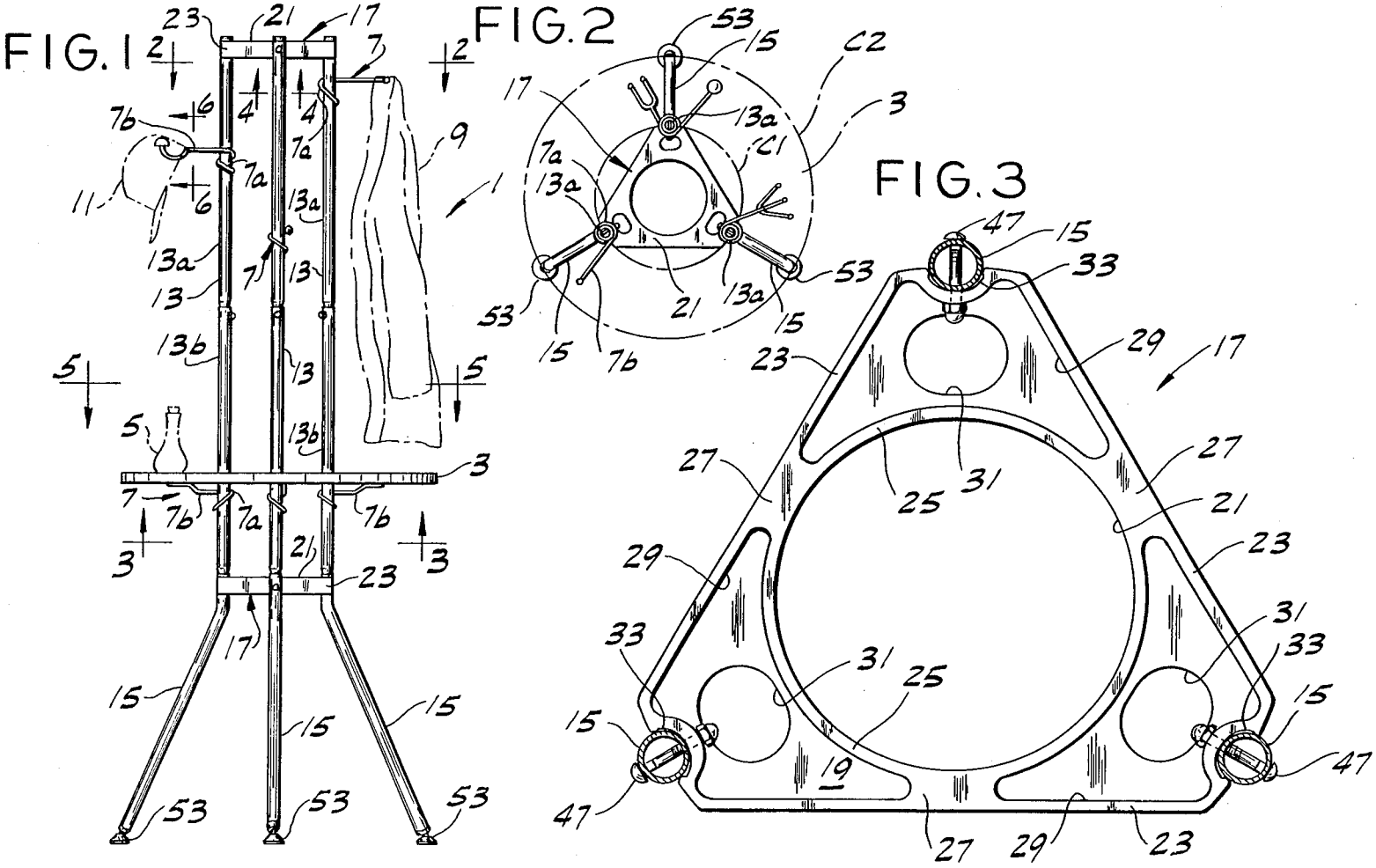
FIG. 1 side elevation of a knockdown rack of this invention having a table top and hangers with items hung on the hangers and sitting on the table shown in phantom.
FIG. 2 is a horizontal section on line 2—2 of FIG. 1.
FIG. 3 is an enlarged horizontal section on line 3—3 of FIG. 1 showing a support structure.

Referring to FIG. 1, a knockdown rack of this invention is indicated in its entirety at 1. It is shown having a table top 3 for setting items thereon, such as a vase 5, and hangers 7 for hanging items like a coat 9 or a hat 11. However, it is to be understood that this rack 1 is not limited to hanging items of apparel but may also be used for such things as fishing equipment, lawn and garden tools, etc. The rack 1 comprises three vertical posts 13 having diverging legs 15 at their lower ends for stably supporting the rack, and a pair of supports 17 fastened between the posts 13 at vertically spaced locations for rigidly interconnecting the posts. As shown in FIG. 2, when viewed from above rack 1, the posts 13 lie generally on a first circle C1 with the posts spaced at about 120 degree intervals on the circle. The diameter of circle C1 may be, for example, approximately 13 inches (33.02 cm). The lower ends of the legs 15 lie generally on a second circle C2 which is larger in diameter (e.g., 25 inches or 63.5 cm) than circle C1.

As shown in FIGS. 1 and 3, each support 17 is molded of a synthetic resin material such as a high density styrene, ABS or foamed plastic and comprises a relatively thin flat body or web 19 of generally triangular shape, having a relatively large circular opening 21 therein, a downwardly extending outer peripheral flange 23 all around the web, and a downwardly extending inner flange 25 all around the opening at the periphery thereof. The support is molded with integral interconnections or ribs 27 between the outer and inner flanges generally at the midpoints of the three sides of the triangular body or web for stiffening the support. This arrangement provides three cavities as indicated at 29 in the bottom of the support between the outer and inner flanges, with each cavity having an opening 31. The body or web 19 and the outer and inner flanges are thin relative to the diameter of the posts 13 and legs 15. At each of the three corners or apices of triangular support 17, outer flange 23 is formed to have an inwardly extending generally arcuate shaped recess 33 for receiving one of the posts 13 or legs 15.

Figure 4:
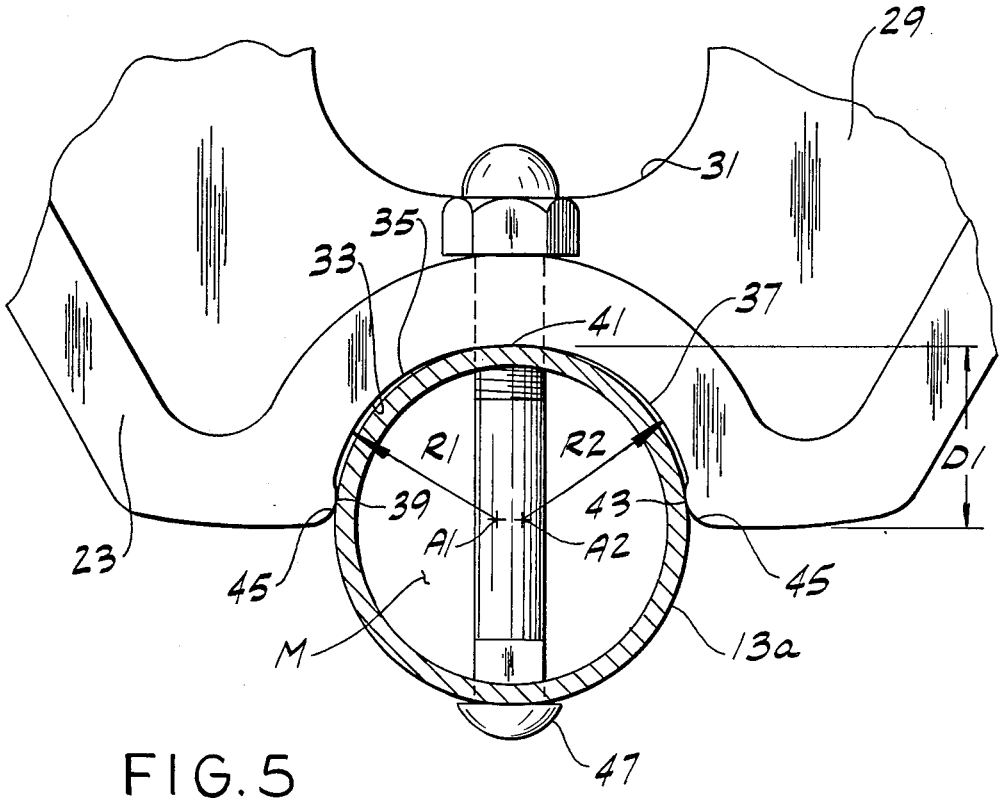
FIG. 4 is an enlarged horizontal section on line 4—4 of FIG. 1 showing a leg of the rack secured in a recess of a support structure.
Figure 5:
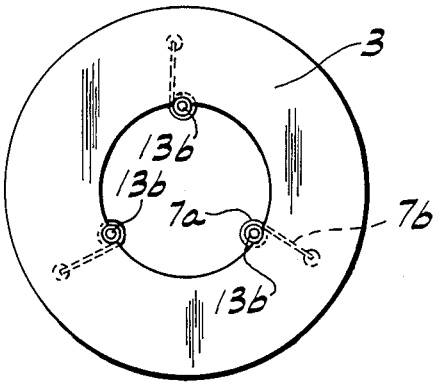
FIG. 5 is a horizontal section on line 5—5 of FIG. 1 showing the table top.

As shown more particularly in FIG. 4, each recess 33 has a mouth M for receiving a respective post section 13*a*. The wall structure of each recess has first and second vertical wall portions 35 and 37, respectively, formed and configured to contact the post 13 at three locations 39, 41 and 43 on the circumference of the post 13. The first vertical wall portion 35 has a first radius of curvature R1 centered on a first vertical axis Al and the second vertical wall portion 37 has a second radius of curvature R2 centered on a second vertical axis A2. The first and second vertical axes A1 and A2, respectively, are located inside the first circle C1 on opposite sides of a vertical radial plane of the first circle passing generally through the center of the post section 13*a* in the recess 33. The first and second radii of curvature R1 and R2, respectively, are approximately equal, and are somewhat less than one-half the outside diameter of the post 13 in the recess 33. Each of the recesses further has a pair of protuberances 45 on opposite sides of the recess and defining mouth M. The protuberances 45 are in the form of vertical ribs and are grippingly engageable with a respective post 13 at two of the three contact locations 39 and 43. Each rib 45 extends substantially the full height of the wall structure and is engageable with the post 13 along substantially the entire length of the rib 45. The third location or line of contact 41 by the post 13 is along a line represented by the intersection between the wall structure and vertical radial plane of the first circle Cl passing generally through the center of the post 13.

Figure 7:
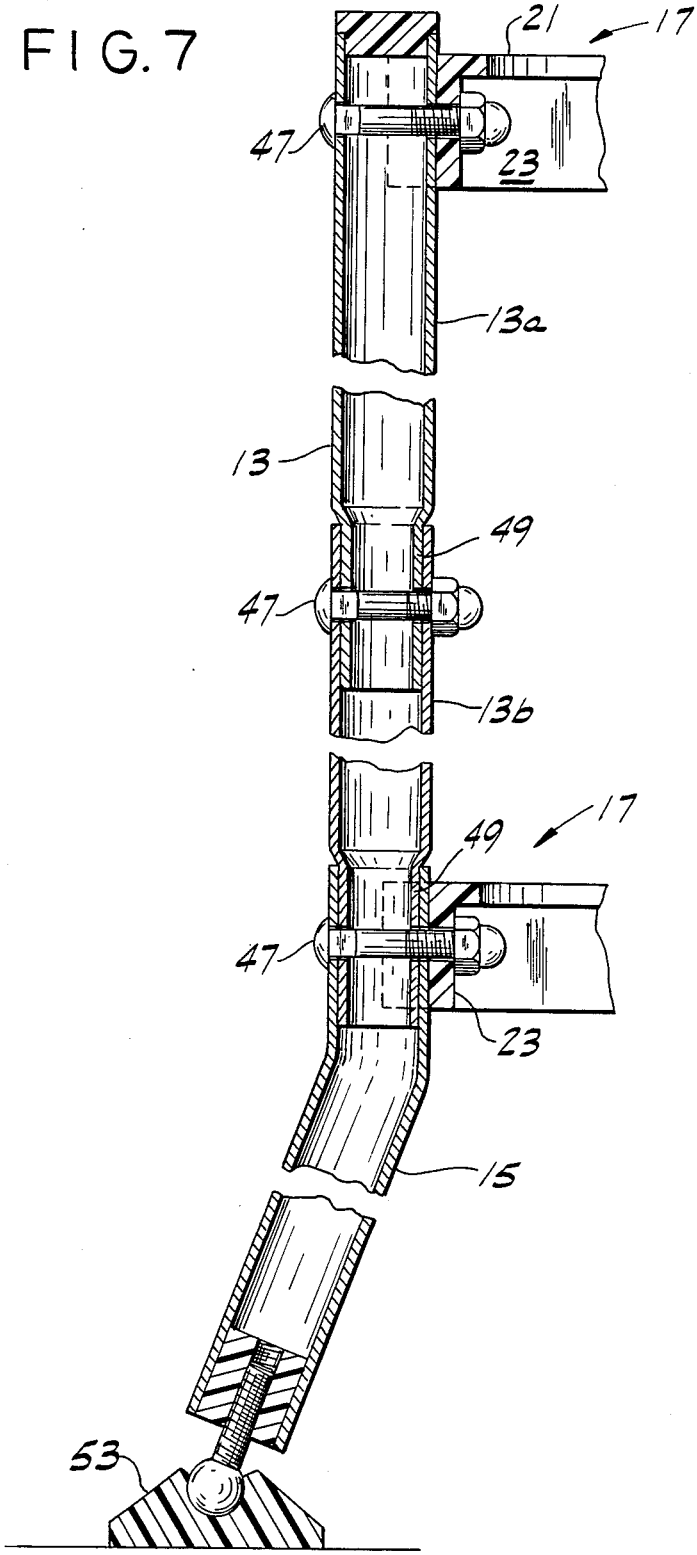
FIG. 7 is an enlarged vertical section through a leg of the knockdown rack.

The wall structure of each recess 33 is designed to yield slightly upon insertion of a respective post 13 into recess 33 and grip the post. The wall structure, as shown in FIG. 7, further has a height which is somewhat greater than the diameter of the respective post 13. This relationship provides for engagement of the wall structure with a substantial length of the post at locations 39, 41 and 43. Although the height of the wall structure could be decreased, it should not be substantially less than the diameter of the respective post. The depth D1 of each recess 33 is approximately equal to one-half the outside diameter of the respective post, but in any case, should not be substantially less than one-half the outside diameter of the respective post. Indicated at 47 is a carriage bolt which constitutes means for releasably fastening each post 13 in a respective recess 33 in each support member 17.

The three lines of contact of the post 13 at three separate locations 39, 41 and 43 and the height of the wall structure prevents racking (pivoting of the posts on the axes of the bolts 47) in virtually every direction.

Each of the posts 13 comprises two identical straight lengths or sections 13*a* and 13*b* of round tubing terminating in leg 15 of the same diameter tubing but which is bent at an angle (e.g., approximately 22 degrees). As shown in FIG. 7, post sections 13*a*, 13*b* have bottom end portions 49 of reduced diameter so as to have an outside diameter approximately equal to the inside diameter of the tubing. The bottom end 49 of section 13*a* is fitted into the top end of section 13*b* and the bottom end 49 of section 13*b* is fitted into the top end of leg 15 to form rigid telescoping joints. Additional bolts 47 secure post sections 13*a* and 13*b* together at these interfitting joints. Pivotal feet 53 are provided at the bottom ends of legs 15.

Figure 6:
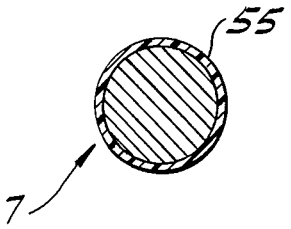
FIG. 6 is an enlarged vertical section through a hanger.

The rack 1 further comprises a plurality of hangers 7 which are positioned on the posts 13 so that they extend laterally outwardly from the posts for holding or supporting items. Each hanger 7 has a single helical convolution 7*a* at one end thereof and an arm 7*b* with a length that does not extend beyond the second circle C2, as seen in FIG. 2. A hanger 7 may be simply applied to or removed from post 13 at any elevation by rotating it relative to the post. As shown in FIG. 6, hanger 7 which, for example, may be formed of one-quarter inch (0.635 cm) diameter rod, has a non-slip resilient coating 55 of synthetic resin thereon, e.g., a vinyl resin approximately 0.04 inches (0.1 cm) thick for substantially preventing the hanger from sliding down the post 13 particularly when no load or only a relatively light load is placed on the hanger. The resin coating also permits slightly wider tolerances for the dimensioning of the diameter and spacing of the single 360 degree helical convolution 7*a* in order to insure that these hangers stay in a desired position.

An optional flat annular table top 3 is supported in a generally horizontal position around the posts 13 on a plurality of hangers 7. The table top 3, e.g., may have an outside diameter of approximately 28 inches (71.12 cm) and an inner diameter of approximately 13 inches (33.02 cm).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A knockdown rack comprising three vertical posts having diverging legs at their lower ends for stably supporting the rack, and a pair of supports adapted to be fastened between the posts at vertically spaced locations for rigidly interconnecting the posts in a formation wherein the posts, as viewed from above the rack, lie generally on a first circle with the posts spaced at about 120 degree intervals on the circle and the lower ends of said legs lie generally on a second circle larger in diameter than said first circle, each support comprising a relatively flat horizontal member having three peripheral recesses therein for receiving said posts, each recess having a mouth for insertion of a respective post inwardly through the mouth into the recess, and a wall structure formed and configured for contact by the post at three separate locations on the circumference of the post, said wall structure having a height not substantially less than the diameter of a respective post for engagement with a substantial length of the post at said locations, and means for releasably fastening each post in a respective recess in each support member.

2. A knockdown rack as set forth in claim 1 wherein the depth of each recess is not substantially less than one-half the outside diameter of a respective post.

3. A knockdown rack as set forth in claim 2 wherein the depth of each recess is approximately equal to one-half the outside diameter of a respective post.

4. A knockdown rack as set forth in claim 2 wherein said posts are generally round in cross section and said recesses are arcuate in shape.

5. A knockdown rack as set forth in claim 1 wherein the wall structure of each recess, upon insertion of a respective post thereinto the recess, is adapted to yield slightly and grip the post.

6. A knockdown rack as set forth in claim 1 wherein each support member is generally triangular in shape, said recesses being located generally at the apices of said member.

7. A knockdown rack as set forth in claim 1 wherein said posts comprise lengths of round tubing.

8. A knockdown rack as set forth in claim 1 further comprising a plurality of hangers adapted for placement on the posts in a position in which they extend laterally outwardly from the posts, the length of each hanger being such that it does not extend substantially beyond said second circle as viewed from above the rack.

9. A knockdown rack as set forth in claim 8 wherein each hanger comprises a single helical convolution at one end and an arm extending outwardly therefrom, said hanger being adapted to be mounted on the post with the post extending through said convolution and the arm extending laterally outwardly from the post for holding an item on the rack, said loop having a non-slip resilient coating thereon for substantially preventing the hanger from sliding down the post.

10. A knockdown rack as set forth in claim 9 wherein said coating is a synthetic resin coating.

11. A knockdown rack comprising three vertical posts having diverging legs at their lower ends for stably supporting the rack, each post being generally round in cross section, and a pair of supports adapted to be fastened between the posts at vertically spaced locations for rigidly interconnecting the posts in a formation wherein the posts, as viewed from above the rack, lie generally on a first circle with the posts spaced at about 120 degree intervals on the circle and the lower ends of said legs lie generally on a second circle larger in diameter than said first circle, each support comprising a relatively flat horizontal member having three peripheral recesses therein for receiving said posts, each recess arcuate in shape and having a mouth for insertion of a respective post inwardly through the mouth into the recess, each recess having a depth not substantially less than onehalf the outside diameter of a respective post, and each recess having a wall structure formed and configured for contact by the post at three separate locations on the circumference of the post, said wall structure comprising a first vertical wall portion having a first radius of curvature centered on a first vertical axis, and a second vertical wall portion having a second radius of curvature centered on a second vertical axis, said first and second vertical axes being located inside said first circle on opposite sides of a vertical radial plane of said first circle passing generally through the center of the post in the recess, said wall structure having a height not substantially less than the diameter of a respective post for engagement with a substantial length of the post at said locations, and means for releasably fastening each post in a respective recess in aach support member.

12. A knockdown rack as set forth in claim 11 wherein said first and second radii of curvature are approximately equal.

13. A knockdown rack as set forth in claim 12 wherein said first and second radii of curvature are somewhat less than one-half the outside diameter of the post in the recess.

14. A knockdown rack comprising three vertical posts having diverging legs at their lower ends for stably supporting the rack, and a pair of supports adapted to be fastened between the posts at vertically spaced locations for rigidly interconnecting the posts in a formation wherein the posts, as viewed from above the rack, lie generally on a first circle with the posts spaced at about 120 degree intervals on the circle and the lower ends of said legs lie generally on a second circle larger in diameter than said first circle, each support comprising a relatively flat horizontal member having three peripheral recesses therein for receiving said posts, each recess having a mouth for insertion of a respective post inwardly through the mouth into the recess, and a wall structure formed and configured for contact by the post at three separate locations on the circumference of the post, said wall structure of each recess comprising a pair of protuberances on opposite sides of the recess at the mouth of the recess, said protuberances being grippingly engageable with a respective post at two of said three contact locations, and said wall structure having a height not substantially less than the diameter of a respective post for engagement with a substantial length of the post at said locations and adapted, upon insertion of a respective post thereinto the recess, to yield slightly and grip the post, and means for releasably fastening each post in a respective recess in each support member.

15. A knockdown rack as set forth in claim 14 wherein said protuberances are in the form of vertical ribs extending substantially the full height of said wall structure, each rib being engageable with a respective post along substantially the entire length of the rib.

16. A knockdown rack as set forth in claim 14 wherein the wall structure of each recess is adapted for contact by a respective post at the third of said three contact locations along a line of contact represented by the intersection between the wall structure and a vertical radial plane of said first circle passing generally through the center of the post.

17. A knockdown rack comprising three vertical posts having diverging legs at their lower ends for stably supporting the rack, and a pair of supports adapted to be fastened between the posts at vertically spaced locations for rigidly interconnecting the posts in a formation wherein the posts, as viewed from above the rack, lie generally on a first circle with the posts spaced at about 120 degree intervals on the circle and the lower ends of said legs lie generally on a second circle larger in diameter than said first circle, each support being generally triangular in shape, having a top and a depending outer flange at the periphery of the top and comprising a relatively flat horizontal member having three peripheral recesses located at the apices of said member for receiving said posts, each recess having a mouth for insertion of a respective post inwardly through the mouth into the recess, and a wall structure formed by a portion of said flange and configured for contact by the post at three separate locations on the circumference of the post, said wall structure having a height not substantially less than the diameter of a respective post for engagement with a substantial length of the post at said locations, and means for releasably fastening each post in a respective recess in each support member.

18. A knockdown rack as set forth in claim 17 wherein the top of each support member has a central opening therethrough.

19. A knockdown rack as set forth in claim 18 further comprising a downwardly depending inner flange at the periphery of the central opening.

20. A knockdown rack as set forth in claim 19 wherein the outer and inner flanges of the support member are integrally joined at spaced locations adjacent the midpoint of each side of said triangular support member.

21. A knockdown rack as set forth in claim 17 wherein said support members are substantially identical molded parts of a synthetic resin material.

22. A knockdown rack as set forth in claim 20 wherein each post comprises two identical straight sections of tubing and one bent section of tubing forming said leg, said rack further comprising means for releasably fastening the sections together end to end.

23. A knockdown rack comprising:

three vertical posts having diverging legs at their lower ends for stably supporting the rack;

a pair of supports adapted to be fastened between the posts at vertically spaced locations for rigidly interconnecting the posts in a formation wherein the posts, as viewed from above the rack, lie generally on a first circle with the posts spaced at about 120 degree intervals on the circle and the lower ends of said legs lie generally on a second circle larger in diameter than said first circle, each support comprising a relatively flat horizontal member having three peripheral recesses therein for receiving said posts, each recess having a mouth for insertion of a respective post inwardly through the mouth into the recess, and a wall structure formed and configured for contact by the post at three separate locations on the circumference of the post, said wall structure having a height not substantially less than the diameter of a respective post for engagement with a substantial length of the post at said locations, and means for releasably fastening each post in a respective recess in each support member;

a plurality of hangers adapted for placement on the posts in a position in which they extend laterally outwardly from the posts, the length of each hanger being such that it does not extend substantially beyond said second circle as viewed from above the rack, each hanger comprising a single helical convolution at one end and an arm extending outwardly therefrom, said hanger being adapted to be mounted on the post with the post extending through said convolution and the arm extending laterally outwardly from the post for holding an item on the rack, said loop having a non-slip synthetic resin coating thereon for substantially preventing the hanger from sliding down the post; and a relatively flat annular table top adapted to be supported in a generally horizontal position around said posts on a plurality of said hangers.

* * * * *